US006176354B1

(12) United States Patent
Sauter et al.

(10) Patent No.: US 6,176,354 B1
(45) Date of Patent: Jan. 23, 2001

(54) TRUCK MOUNTED BRAKE BEAM WITH REMOVABLE BRAKE HEADS

(75) Inventors: Jeffrey F. Sauter, Lowville; Robert Gayfer; Zdzislaw Samulak, both of Watertown, all of NY (US)

(73) Assignee: New York Air Brake Corporation, Watertown, NY (US)

( * ) Notice: Under 35 U.S.C. 154(b), the term of this patent shall be extended for 0 days.

(21) Appl. No.: 09/239,829

(22) Filed: Jan. 29, 1999

Related U.S. Application Data

(63) Continuation-in-part of application No. 09/046,847, filed on Mar. 13, 1998, which is a continuation-in-part of application No. 08/874,228, filed on Jun. 13, 1997, now Pat. No. 5,947,236.

(51) Int. Cl.[7] ..... B61H 13/36

(52) U.S. Cl. ..... 188/219.6; 188/235; 188/236; 188/220.1

(58) Field of Search ..... 188/219.1, 219.6, 188/220.1, 220.6, 221.1, 234, 235, 236, 222.1–233.7, 211, 33, 153 R, 244, 242, 246

(56) References Cited

U.S. PATENT DOCUMENTS

| | | | |
|---|---|---|---|
| 568,044 | 9/1896 | Robischung . | |
| 575,420 | 1/1897 | Farley . | |
| 794,404 | 7/1905 | Green . | |
| 796,714 | 8/1905 | Frost . | |
| 979,968 | 12/1910 | Kofske . | |
| 994,323 * | 6/1911 | Marquart | 188/220.1 |
| 1,144,403 | 6/1915 | Williams, Jr. . | |
| 1,203,469 | 10/1916 | Busse . | |
| 2,116,594 | 5/1938 | Busch . | |
| 2,182,210 | 12/1939 | Osner et al. . | |
| 2,329,247 | 9/1943 | Busse et al. . | |
| 2,480,857 | 9/1949 | Hess . | |
| 2,491,086 | 12/1949 | Busch . | |
| 2,517,199 | 8/1950 | Gothberg . | |
| 2,885,036 | 5/1959 | Walker . | |
| 3,499,507 | 3/1970 | Scott et al. . | |
| 3,907,078 | 9/1975 | Means . | |
| 4,653,812 | 3/1987 | Engle . | |
| 4,766,980 | 8/1988 | Engle . | |
| 4,771,868 | 9/1988 | Haydu . | |
| 4,793,446 | 12/1988 | Hart et al. . | |
| 5,069,312 | 12/1991 | Kanjo et al. . | |
| 5,400,874 | 3/1995 | Gayfer et al. . | |
| 5,495,921 | 3/1996 | Samulak et al. . | |
| 5,806,634 | 9/1998 | Engle . | |
| 5,810,124 | 9/1998 | Sandmann . | |

* cited by examiner

*Primary Examiner*—Douglas C. Butler
(74) *Attorney, Agent, or Firm*—Barnes & Thornburg

(57) ABSTRACT

A truck mounted rail brake including at least a primary beam having a center section and a pair of end sections with guide end extensions. A brake head is removably mounted to the end sections by a pin. The pin is dimensioned to allow pivotal movement of the brake head about the pin. The pin is retained in the brake head by either a tab or another pin above and transverse to the first pin.

24 Claims, 6 Drawing Sheets

TRUCK MOUNTED BRAKE BEAM WITH REMOVABLE BRAKE HEADS

CROSS REFERENCE

This is a continuation-in-part of U.S. application No. 09/046,847, filed Mar. 13, 1998, which is a continuation-in-part of U.S. application Ser. No. 08/874,228, filed Jun. 13, 1997, now U.S. Pat. No. 5,947,236.

BACKGROUND AND SUMMARY OF THE INVENTION

The present invention relates generally to brake designs for rail cars, and more specifically to truck mounted brake systems.

Truck mounted brakes throughout the railroad industry include either a double actuator system as illustrated in U.S. Pat. No. 3,499,507 or a single actuator system as illustrated in U.S. Pat. Nos. 5,400,874 and 5,495,921. In all three of these systems, the actuator rods extend through holes in the bolster of the truck. The primary and secondary beams are unitary cast iron beams. The beams are U-shaped having a vertical base and two horizontal walls extending therefrom. The actuator or actuators are mounted to the vertical base and the actuator rods are mounted and extend through openings also in the vertical base. The brake heads are cast integral at each end of the beam.

Another example of a truck mounted brake having a single actuator is illustrated in U.S. Pat. Nos. 4,766,980 and 4,653,812. By moving the actuator rods outside of the center section, they pass under the bolster of the truck and no holes through the bolsters are required. The brake beams are shown as having a rolled steel center channel section with removable end sections having cast brake shoe heads and projecting guide end extensions bolted to the center section. The load on the beam is carried by the bolts which join the end sections to the center section. As with the previous unitary beams, the channeled portion is generally U-shaped having a vertical base wall with two opposed horizontal walls extending therefrom.

A unitary brake head and projecting guide end extensions secured to a bow type beam by fasteners is illustrated in U.S. Pat. Nos. 5,810,124 and 5,069,312. Again, the fasteners are load bearing and as described in the '124 Patent, rivets are used. Separate brake shoe heads and guide end extensions being secured by a common fastener is illustrated in U.S. Pat. No. 2,491,086. As in the '124 Patent, from the same assignee, rivets are used since they are a load bearing connection. Removable brake heads are also shown in U.S. Pat. Nos. 4,771,868 and 5,806,634.

There is a continuous drive to reduce the cost, size and weight of the truck mounted brake.

The present invention is a truck mounted rail brake including at least a primary beam having a center section and a pair of end sections with guide end extensions to be received in the slots of the truck. The center portion may include two opposed channel elements joined to each other and each having a horizontal base and two vertical walls. A brake actuator is connected to the primary beam and a brake head is removably joined to each end section of the beam. Preferably, the brake head is joined to the end section by a pin. In one embodiment, a tab is provided on the head and a portion of the tab is bent over the pin to retain it in the brake head and the end section. In a second embodiment, a second pin is removably joined to the brake head and extends above the first pin along an axis transverse to and intersecting an axis of the first pin to retain the first pin in the brake head and the end section. The first pin is dimensioned to allow the brake head to pivot about the first pin whose axis is transverse to the longitudinal axis of the beam.

With respect to the beam, the vertical walls of the opposed channeled elements may extend either from the base towards each other or away from each other. The channel elements are joined by a first weldment. The first weldments are hollow and the bases include openings to the hollow of the first weldments. The cross-section of the end portions of at least one of the channeled elements are smaller than the cross-section of a center portion of the at least one channeled element.

A second brake beam may be included also having a center section with a pair of end sections including guide end extensions. The second beam also includes at least one channel member having a horizontal base and two vertical walls.

Another truck mounted rail brake would include at least a primary beam including a center section, and at each end, an end section having a guide end extension to be received in the slots in a truck. A brake head has a slot in the back which receives the end sections and which allows removal of the brake head transverse the longitudinal axis of the beam. A first pin extends through the aligned aperture in a wall of the slot and in the end section and removably maintains the brake head on the end section. In one embodiment, a tab is provided on the brake head and a portion of the tab is bent over the pin to retain the pin in the brake head and the end section. In a second embodiment, an opening is provided in the brake head above the slot and has an axis transverse to and intersecting coaxial axis of the aligned apertures. A second pin extends through the opening above the first pin to retain the first pin in the apertures.

The brake beam further includes two transverse walls, one on each side of the brake head to limit the movement of the brake head along the longitudinal axis. The slot, first pin and separation of the transverse wall is already dimensioned to allow the brake head to pivot about the pin. The slot is formed by two flanges extending from the back of the brake head and vertically spaced sufficiently to receive the end section of the beam. A portion of the center section of the beam extends laterally below a portion of the end section. A third flange extends from the back of the beam and is vertically spaced from the other two flanges sufficiently to engage a portion of the center section of the beam below the end section as a stop.

Another truck mounted brake includes at least a primary beam including along a longitudinal axis, a center section and at each end, an end section having an end extension to be received in a slot in a truck. A brake head is removably mounted to the end extension by a first pin which is dimensioned to allow the head to pivot about the pin, whose axis is transverse to the longitudinal axis of the beam. As in the previous embodiments, the first pin is retained either by a tab on the brake head or a second pin which extends above the first pin along an axis transverse to and intersecting the axis of the first pin.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
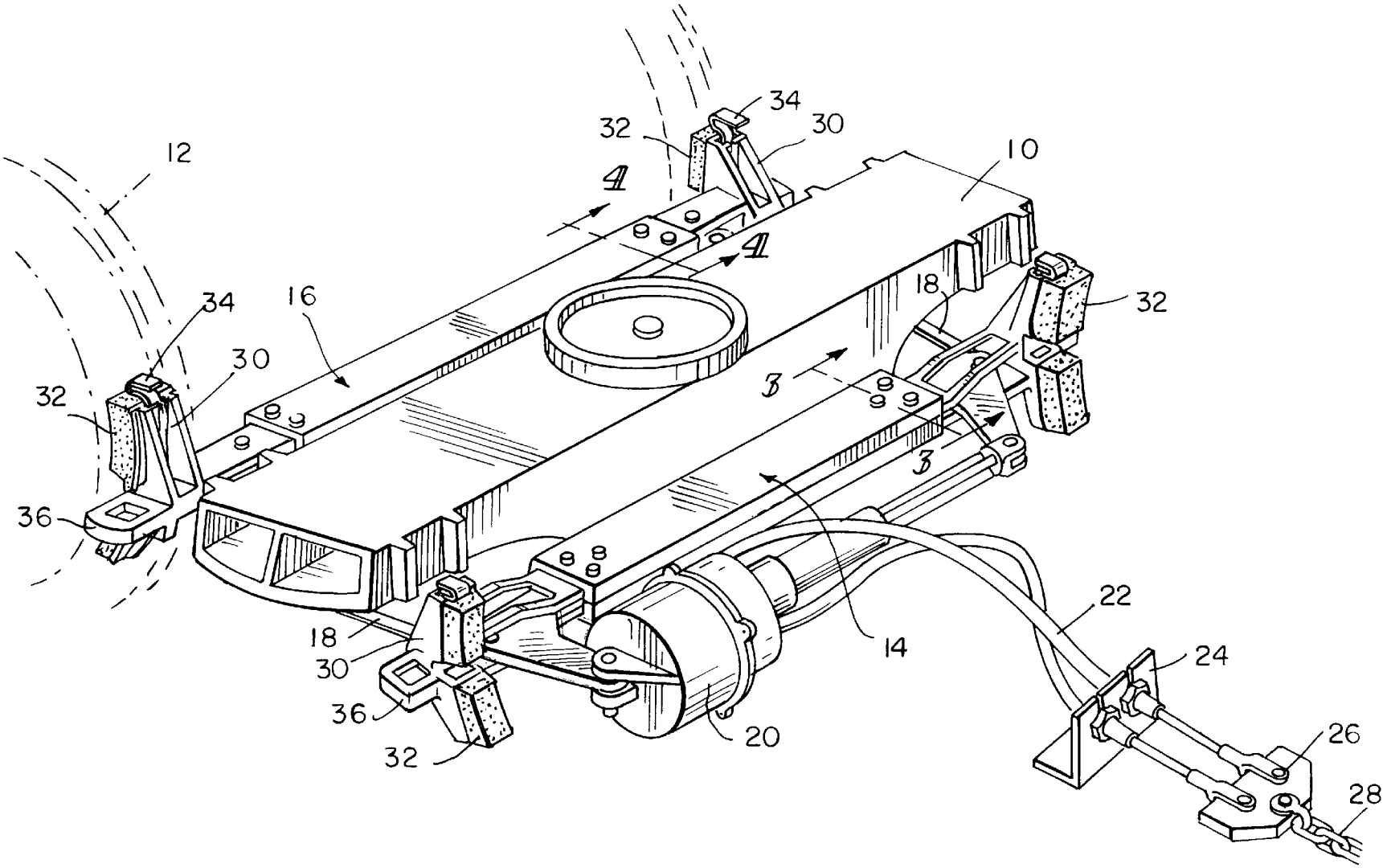
FIG. 1 a perspective view of a truck mounted brake mounted the truck incorporating the principles of the present invention.

A truck mounted brake is shown in FIG. 1 with respect to bolster 10 of the truck and a wheel 12. The illustration is for a double axle truck and therefore will be described with respect to two brake beams.

Figure 2:
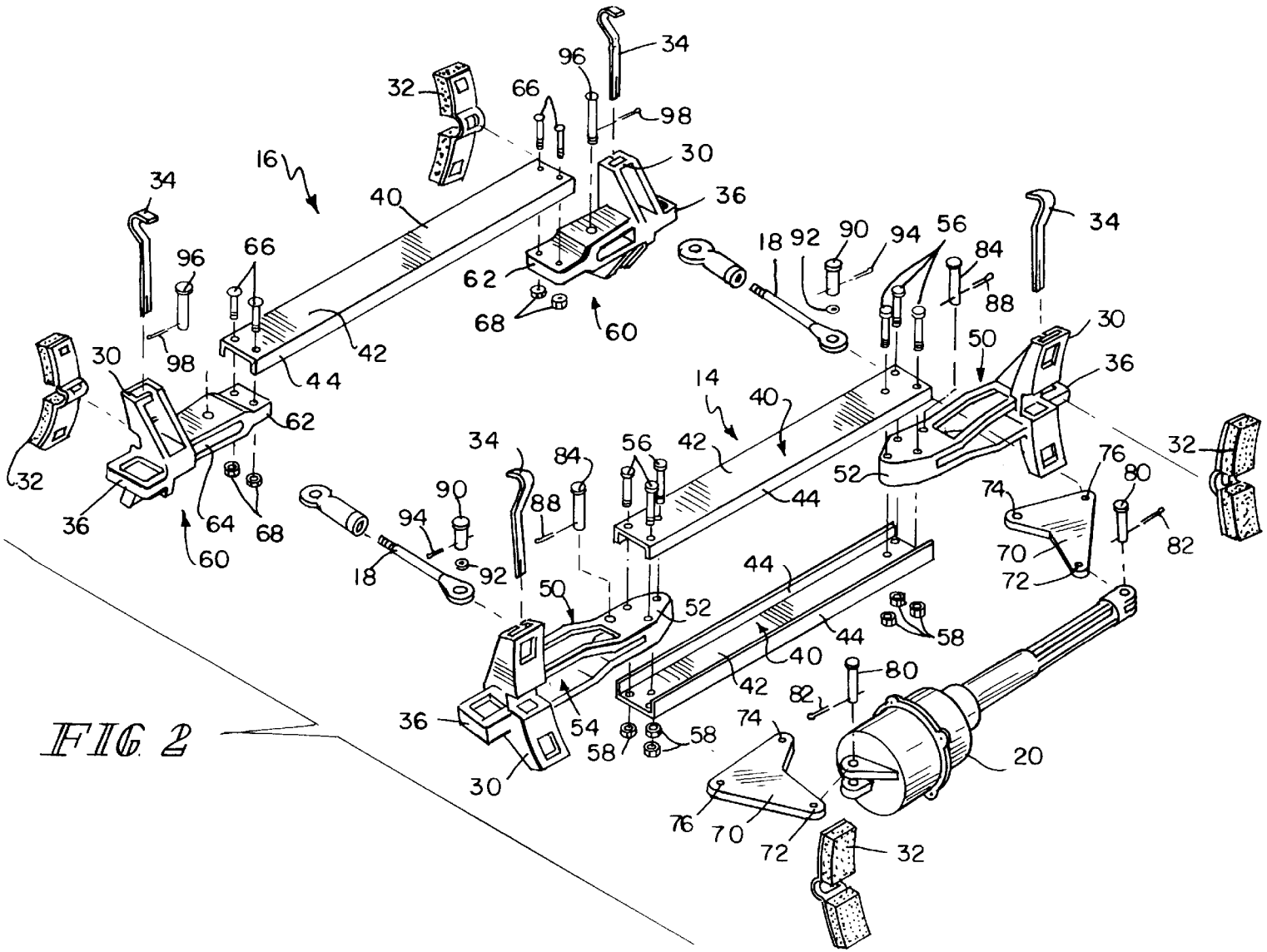
FIG. 2 is an exploded view of the truck mounted brake of FIG. 1 incorporating the principles of the present invention.

The truck mounted brake illustrated in FIGS. 1 and 2 include a primary brake beam 14 and a secondary brake beam 16 on opposite sides of the bolster 12 and interconnected by force transmission or push rod assembly 18. An actuator 20 is supported by the primary beam 14 and is connected to the secondary beam 16 by the push rods 18. A hand brake cable 22 is connected to the actuator 20 and to cable reaction bracket 24, equalization plate 26 and chain 28.

At each end of the primary beam 14 and the secondary beam 16, is a brake head 30 having brake shoes 32 secured thereto by removable shoe key 34. Also, extending from the ends of each of the brake beams are guide end extensions 36 which are received in slots in the side frames of the truck. Each of the brake heads 30 and brake shoes 32 are adjacent to respective wheel 12, only one of which is illustrated.

The system so far described is well known in the industry and is illustrated for example, in U.S. Pat. Nos. 4,766,980 and 4,653,812. The operation of the actuator 20, with or without slack adjusters, and the push rod assemblies 18 to operate the pair of brake beams 14 and 16 is well known and will not be described here in detail.

Figure 3:
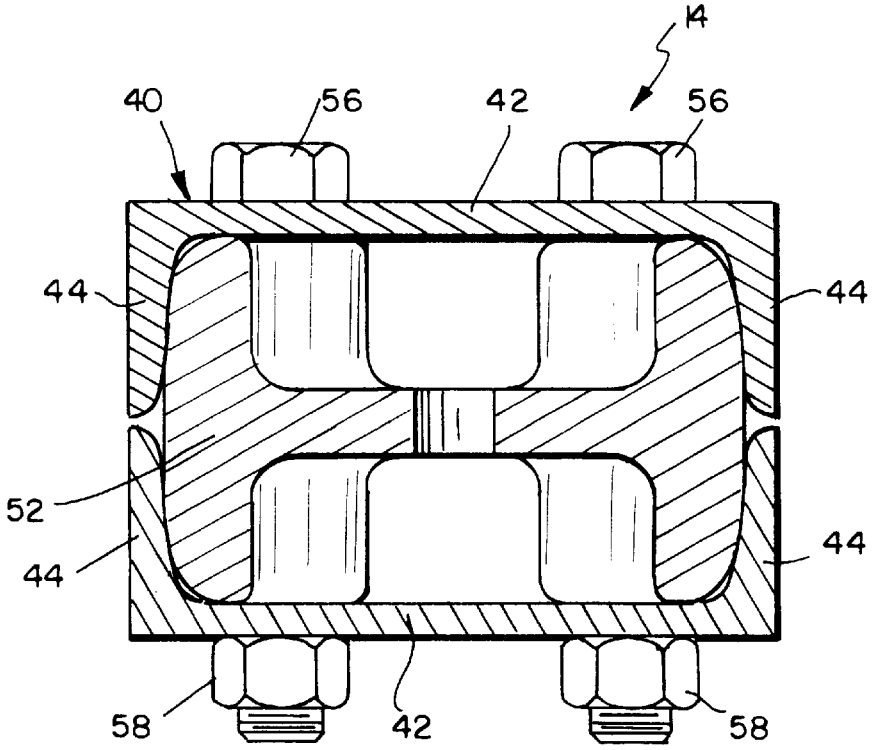
FIG. 3 is a cross section taken along lines III—III of FIG. 1 of the primary beam.
Figure 4:
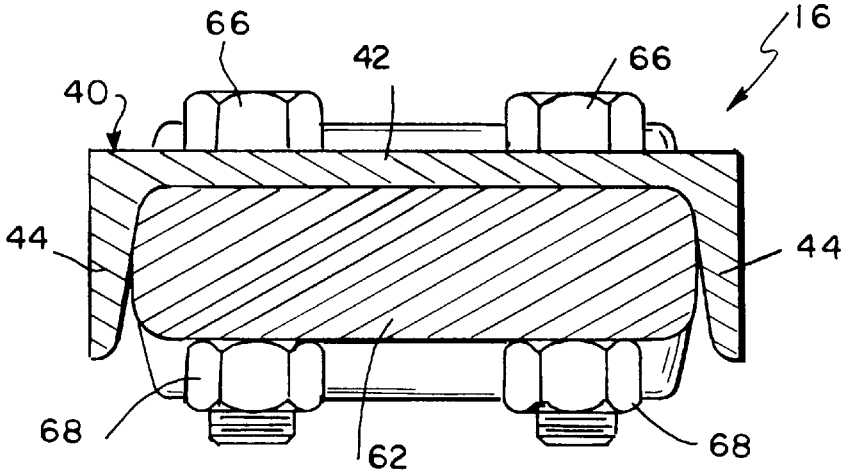
FIG. 4 is a cross section taken along lines IV—IV of FIG. 1 of the secondary brake beam.

A first embodiment of the improved brake beam system of the present invention is illustrated in detail in FIGS. 2–4. The primary beam 14 and the secondary beam 16 each include a center section having one or more channeled elements 40 each including a horizontal base 42 and pair of vertical side walls 44. While the secondary beam 16 includes only one channel member 40, the primary beam 14 includes a pair of opposed channel members 40. In both beams, the base 42 is horizontal and the side walls 44 are vertical. This increases the stiffness of the center of the beams to braking forces transverse to the side walls 44 and within the plane of the base 42. This is to be distinguished from the U-shaped beams of the prior art wherein the corresponding base wall 42 is vertical and the corresponding side walls 44 are horizontal.

The specific orientation and design of the present center sections 40 allows them to be standard U or C channeled stock of substantially reduced weight and cost compared to that of the prior art brake beams. The channeled stock has a large radius of curvature or thickened intersection of the vertical walls 44 to the base 42 which increases the rigidity. Also, box channel or rectangular cross-section stock may be used. Another advantage of using stock channels for the center section of the beam is easy of modification for different gauge tracks. No redesign or special forging is needed.

The primary brake beam 14 includes a pair of end section 50 having a tongue portion 52 slidably received within the channel of the center section 40. An opening 54 is provided in the end section 50 for the force transmission mechanism or the push rods 18. Fasteners 56 extend through aligned apertures in the base wall 42 of the center section and the tongue 52 of the end section and into nuts 58 to secure the end sections in their extended position relative to the center section 40. Fasteners 56 secure or lock the end sections in their extended position and secure the pair of center sections 40 to each other.

The secondary beam 16 also includes a pair of end sections 60 having a tongue 62 received within the channel of the center section 40. A pair of fasteners 66 extend through the horizontal wall 42 of the center section 40 and through aligned apertures in the tongue 62 of the end section 60 and into nuts 68 to secure the end sections in their extended position relative to the center section 40.

The actuator 20 is supported by the primary brake beam 16 through bell crank lever 70. Opposite ends of the actuator 20 are secured by pins 80 received through aperture 72 in the bell crank 70. A cotter pin 82 connected through the end of the pin 80. The bell crank 70 is pivotally connected to the end section 50 in opening 54 of the first beam by a pin 84 received in aperture 74. A cotter pin 88 is provided at the end of pin 84 to secure it in place. One end of the push rod assembly 18 is secured to the bell crank 70 by a pin 90 received in aperture 76 of the bell crank 70. A bushing 92 is provided in aperture 76 of the lever 70 and a cotter pin 94 holds the pin 90 in place. The other end of the push rod 18 is received in opening 64 of the end section 60 of the second beam 16 and is secured therein by pin 96 and cotter pin 98.

Figure 5:
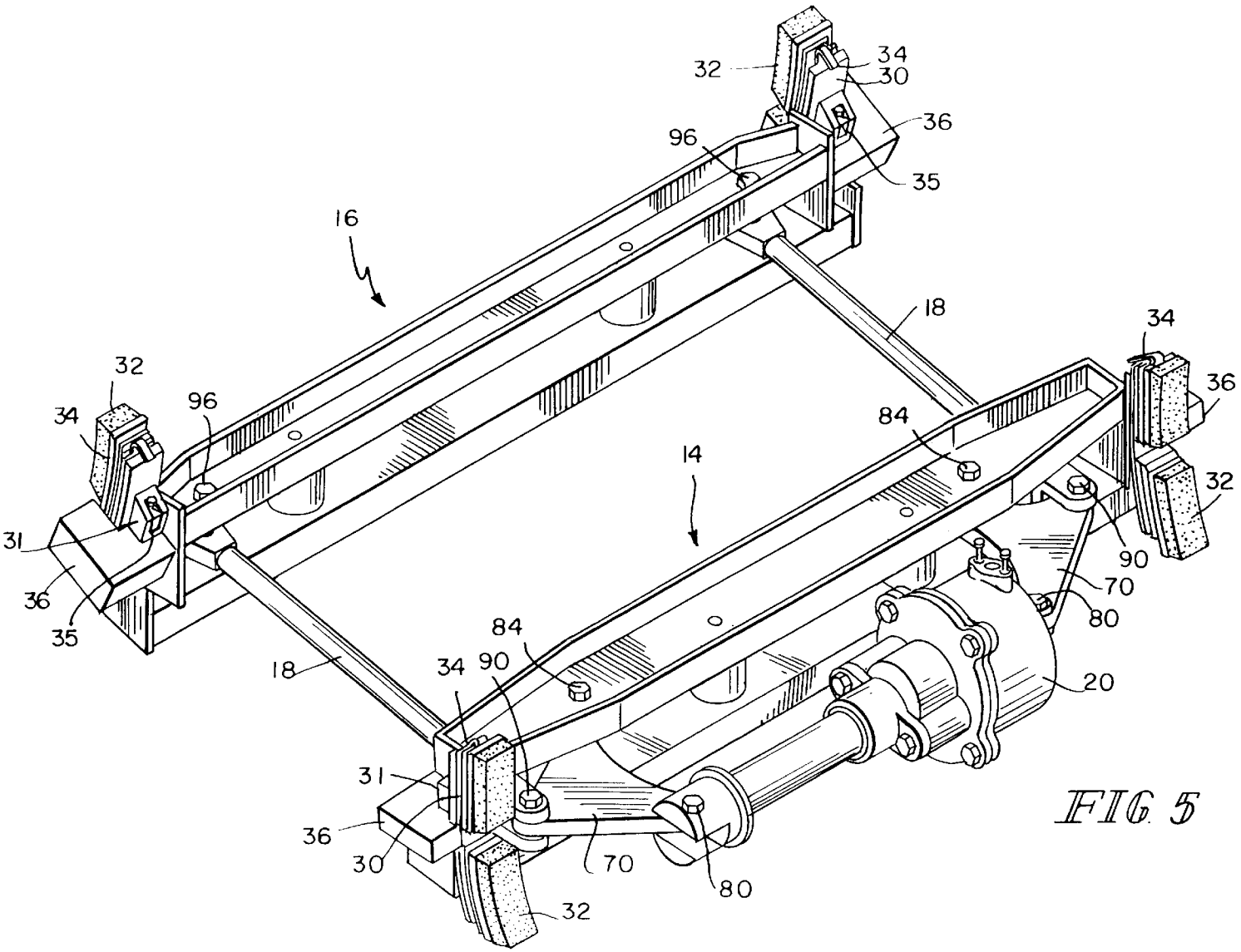
FIG. 5 is a perspective view of another embodiment of a truck mounted brake mounted to the truck incorporating the principles of the present invention.
Figure 6:
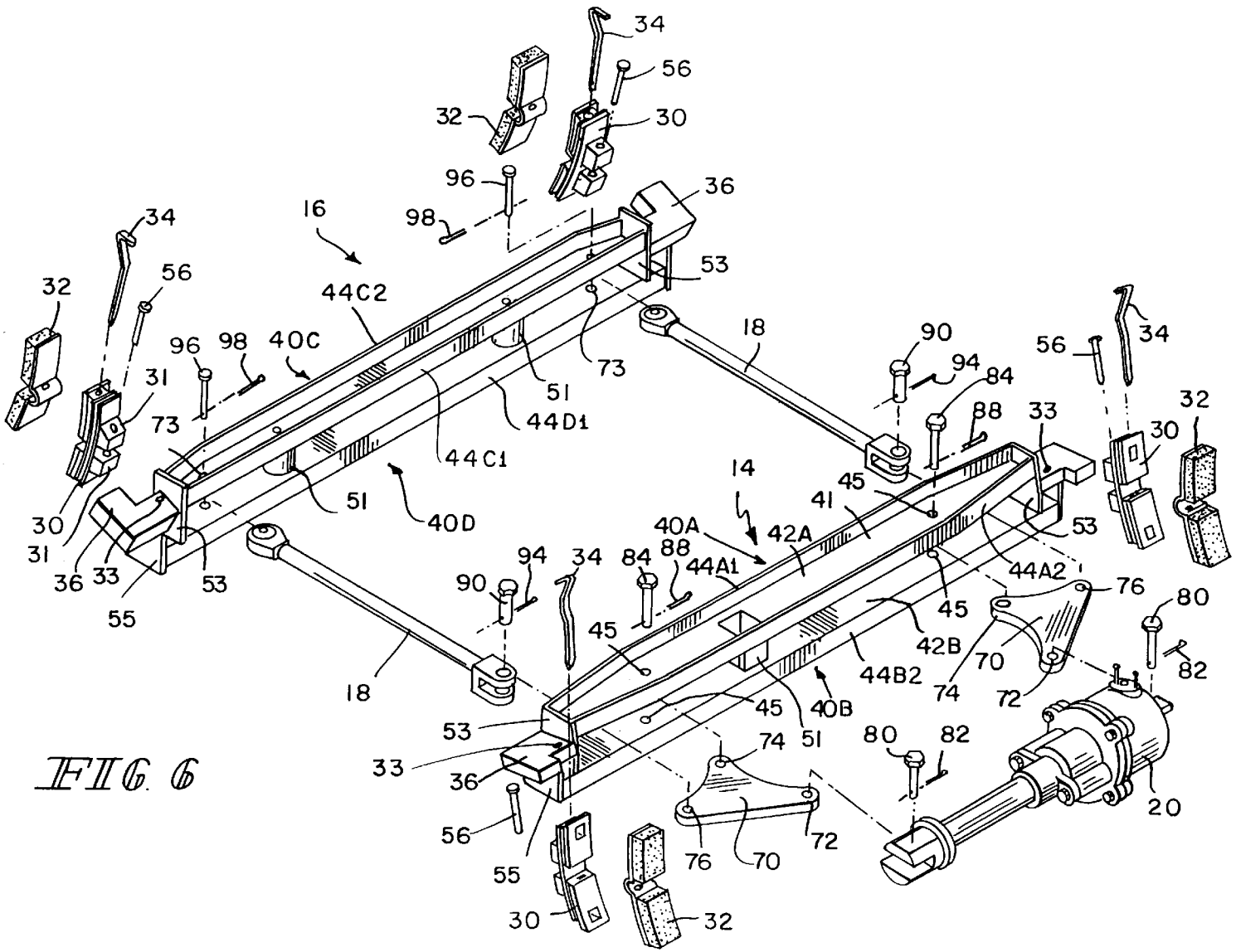
FIG. 6 is an exploded view of the truck mounted brake of FIG. 5.

Another embodiment of the brake beam incorporating the principles of the present invention is illustrated in FIGS. 5 and 6. Those elements which have the same general structure and function as that as in FIGS. 1–4 have the same numbers. Those having modified or new part elements have odd numbers. The purpose of the embodiment of FIGS. 5–8 as distinguished from that of FIGS. 1–4 is that in FIGS. 5 and 6, actuator 20 and push rods 18 stay with the beams and are not removed with the brake heads 30 from the truck. In FIGS. 1–4, the actuator 20 and the connecting rods 18 are removed with the brake heads 30 from the truck.

The primary beam 14 and the secondary beam 16 each include a center section having two opposed channeled elements 40A, B and 40C, D respectively. Each includes a horizontal base 42 and pair of vertical side walls 44. In both beams, the base 42 is horizontal and the side walls 44 are vertical. The specific orientation and design of the present center sections 40 allows them to be standard U or C channeled stock of substantially reduced weight compared to that of the prior art brake beams. Also, box channel or rectangular cross-section stock may be used.

The channeled elements 40 of the primary and secondary brake beams have their opposed bases 42 adjacent with their vertical walls 44 extending away from each other. In the embodiment of FIGS. 1–4, the vertical walls 40 extend towards each other from their opposed bases 42. A pair of first weldments 51 secure the top channeled element 40A, 40C to the bottom channeled elements 40B, D. Preferably, the weldments 51 are tubes. Openings 41 in the base provide access to the hollowed weldments 51 and allows debris and water to run off through the beams. The openings 41 may be smaller than the weldments 51. The top channeled elements 40A, C are shorter in length than the bottom channeled elements 40B, D and are secured to each other at their ends by a second weldment illustrated as a plate 53. The guide end extensions 36 are secured to the center channeled elements 40 by the weldment 53 and a third weldment 55 connected to the bottom channeled element 40B, D.

Referring to FIG. 6, the top channeled element 40A of the primary beam 14 has a smaller cross-section at the ends compared to the cross-section at its center. Both the non-wheel side vertical wall 44A1 and the wheel side vertical wall 44A2 are non-parallel and converge at the ends. The bottom channeled element 40B of the primary beam 14 also has a smaller cross section at its ends than it does at the center. Only the non-wheel side vertical wall 44B1 (not shown) converges towards the unmodified wheel side vertical wall 44B2. Comparing this to the secondary beam 16, only the ends of the wheel side vertical wall 44C2 of the top channeled element 40C converges while the non-wheel side vertical wall 44C1 of the top channeled element 40C and both vertical walls of 44D1, D2 (not shown) of the bottom channeled element 40D remain parallel to the center section.

The actuator 20 is supported by the primary brake beam 14 through bell crank levers 70. Opposite ends of the actuator 20 are secured by pins 80 received through aperture 72 in the bell cranks 70. A cotter pin 82 connected through the end of the pin 80. The bell crank 70 is pivotally connected to the center section 40 of the first beam by a pin 84 received in aperture 74 in the bell crank 70 and bores 45 in bases 42. A cotter pin 88 is provided at the end of pin 84 to secure it in place. One end of the push rod assembly 18 is secured to the bell crank 70 by a pin 90 received in aperture 76 of the bell crank 70. A cotter pin 94 holds the pin 90 in place. The other end of the push rod 18 is received and secured to the center section of channeled element 40 of the second beam 16 by pin 96 and cotter pin 98 through bore 45 in base 42.

Bosses 43 are provided on the base 42 and include the bores 45 which receive the pins 90 and 96. Bell crank 70 is secured and rides between the bosses 43A and 43B and the end of the actuating push rod 18 rides is secured to and rides between the bosses 43C and 43D. For sake of clarity, the bosses 43 have been deleted and are shown in FIGS. 5 and 6. All of the bosses 43 act as spacers for the actuator and push rod assembly. The bottom bosses 43B and 44D also act as wear plates since they support the bell crank 70 and the end of the push rod 18 respectfully. The bosses 43 are mounted or secured to the bases 42 by welding. Obviously, this welding takes place prior to the joining of the channeled elements together.

Since the guide end extensions 36 are unitary with the beam structure, the brake head 30 with the brake shoe 32 are removable from the guide end extensions 36 and the beam. The brake head 30 includes a pair of spaced blocks 31 on its back wall between which is received a portion of the guide end extension. A pin 56 is extended through aligned apertures 33 in the blocks 31 and the guide end extension 36. A tab 35 extending from the top block 31 is bent over the top of the pin 56 to secure it in place. The pin 56 in combination with spacing between the blocks 31 and the guide end extension 36 allows for about 3 degrees of movement about a horizontal axis. Since the load is carried by the beam instead of the pin 56, the mounting need not be fixedly secured. Also, the tab 35 being an integral part of the brake head 30 prevents the pin 56 from being lost.

The brake head 30 is restricted from significant lateral movement by the weldment 53 and a transverse wall of the guide foot 36. This would also minimize rotation or swivelling of the brake head 30 laterally.

To replace the brake head, the shoes 32 must be removed and beams are moved away from the wheel. The tab 35 is straightened and the pin 56 removed. The brake head 30 is then moved towards the wheel until it clears the guide end extension 36 and then is moved parallel to the brake beam. The relationship of the brake head 30 and the blocks 31 to the guide end extension 36 and the weldment 53 transfers the forces on the brake head 30 to the brake beam and is not primarily dependent upon a pin 56.

Figure 7:
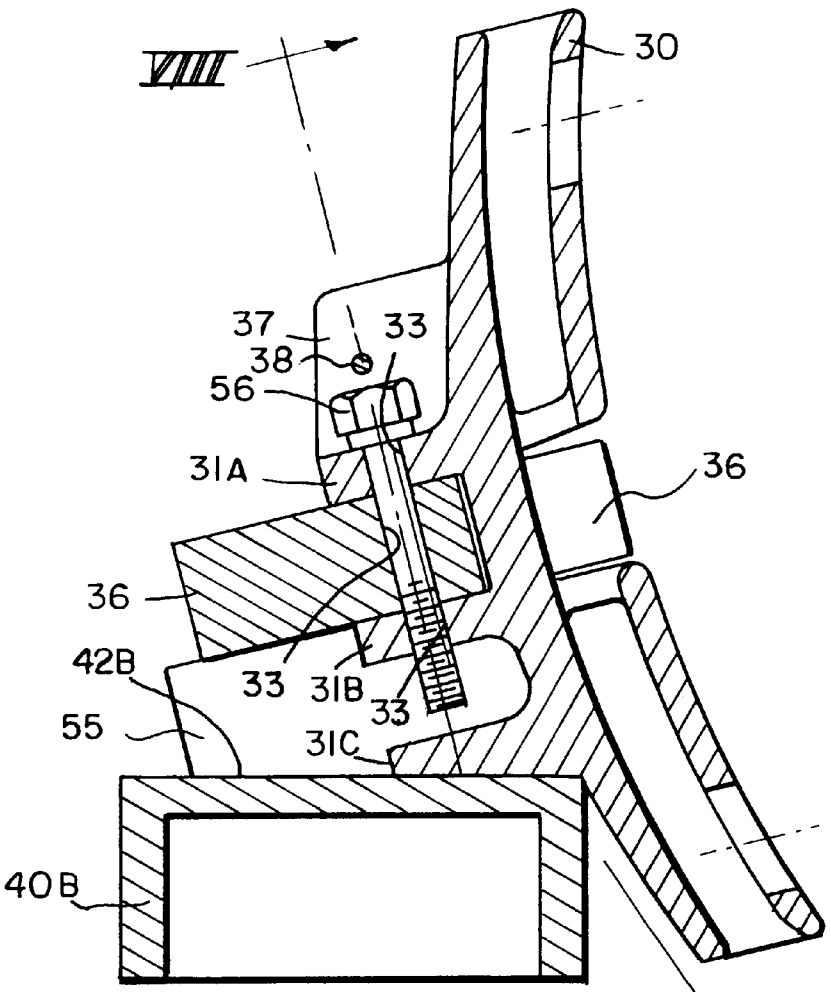
FIG. 7 is a cross sectional view taken along lines VII—VII of FIG. 8 of a brake head on a brake beam according to the principles of the present invention.
Figure 8:
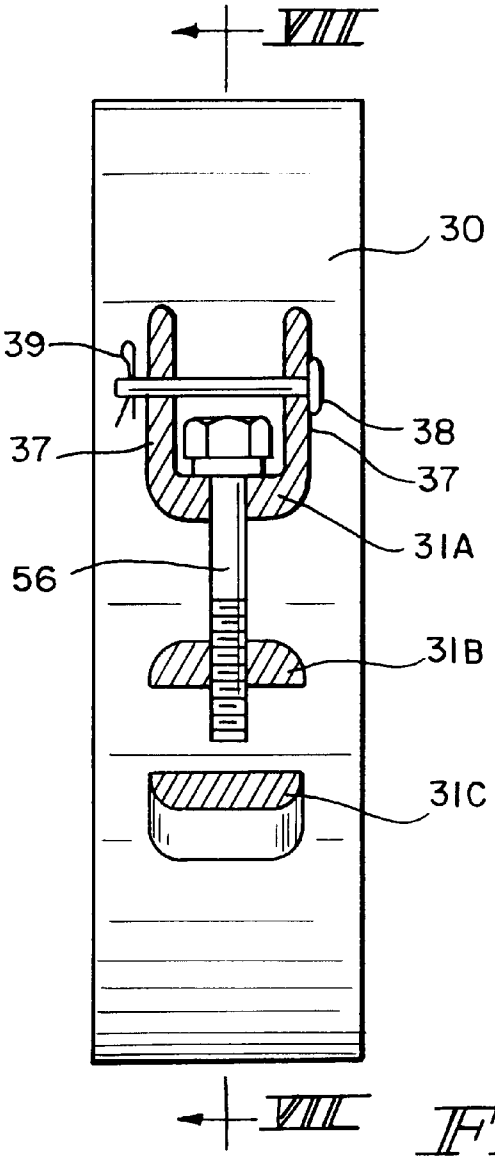
FIG. 8 is a cross sectional view of the brake head taking along lines VIII—VIII of FIG. 7 without the brake beam.

Another embodiment of the brake head is illustrated in FIGS. 7 and 8. This is a cast brake head. The numbers used in FIGS. 5 and 6 having the same function are used in FIGS. 7 and 8. A portion of the beam 14 is illustrated in FIG. 7 but has been deleted from FIG. 8 for clarity. The brake head 30 includes a first pair of flanges 31A and 31B which are spaced sufficiently to receive the guide end extension 36 which is the end portion of the beam. Also provided on the brake head 30 is a third flange 31C spaced below the bottom flange 31B sufficiently spaced such that it acts as a stop against the top surface 42B of the bottom channel 40B. The fastener 56 is a pin which extends through coaxial apertures in the flanges 31A, 31B and aperture 33. The length of the pin 56 is selected such that its head comes to rest on the top of top flange 31A without the bottom of the pin 56 engaging a top surface of flange 31C. The flanges 31A and 31B form a machined slot in the back of the head 30.

To retain the pin 56 in apertures 33, a pair of side walls 37 are provided extending up from the flange 31A. A pin 38 extends through openings in the side walls 37 and are secured thereto by a cotter pin 39. The axis of the pin 38 is above and transverse to and intersects the axis of the pin 56 and the apertures 33. The pin 38 prevents loosely fitting pin 56 from exiting the apertures 33 and thereby maintains in the flanges 31A and B and the end extension 36. Although a pair of side walls are shown as the preferred embodiment, the pin could be removably secured and extend from a single side wall or other structure of the brake head 30. Also, a simple cotter pin with bend ends can be used instead of the pin 38 through the openings in the side walls 37 as an alternative.

Although the removable brake heads 30 of FIGS. 5–8 are shown with the beam structure of FIGS. 5 and 6, the brake head can also be made to be used with the beam structure of FIGS. 1–4 as long as it is not integral to the end extension 36. The securement of the end extension 36 to the beam must be independent of the mounting of the brake head 30 to the beam. Otherwise, the connection would be load bearing and the head of FIGS. 4–8 cannot be used.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A truck mounted rail brake comprising:

at least a primary beam including a center section and at each end an end section having a guide end extension to be received in slots in a truck;

a brake actuator connected to the primary beam;

the center section includes two opposed channeled elements joined to each other and each having a base and two walls extending from the base;

a brake head removably joined to each end section;

a first pin joining the brake head to the end section; and a retainer mounted on the brake head retaining the first pin in the brake shoe and the end section.

2. A brake according to claim 1, wherein the retainer includes a tab on the brake head, a portion of the tab is bent over the pin to retain it in the brake head and the end section.

3. A brake according to claim 1, wherein the retainer includes a second pin removably joined to the brake head and extending above the first pin along an axis transverse to and intersecting an axis of the first pin to retain the first pin in the brake head and the end section.

4. A brake according to claim 1, wherein the first pin is dimensioned to allow the brake head to pivot about the pin whose axis is transverse to a longitudinal axis of the beam.

5. A brake according to claim 1, wherein the walls of the opposed channeled elements extend from the base away from each other.

6. A brake according to claim 5, wherein the channeled elements are joined by first weldments.

7. A brake according to claim 6, wherein the first weldments are hollow and the bases include openings to the hollow of the first weldments.

8. A brake according to claim 1, wherein a cross-section of the end portions of at least one of the channeled elements are smaller than a cross-section of a center portion of the at least one channeled element.

9. A brake according to claim 1, including a secondary beam including:

a center section and at each end an end section having a guide end extension to be received in slots in a truck; and the center section including at least one channeled element having a base and two walls extending from the base.

10. A brake according to claim 9, wherein the center section includes two opposed channeled elements joined to each other and each having a horizontal base and two vertical walls extending from the base.

11. A brake according to claim 1, wherein the channeled elements are joined by first weldments.

12. A brake according to claim 1, wherein the end sections are joined to the channeled elements by second weldments.

13. A truck mounted rail brake comprising:

at least a primary beam including, along an longitudinal axis, a center section and at each end an end section having a guide end extension to be received in slots in a truck;

a brake head having a slot in a back of the brake head which receives the end section and which allows removal of the brake head transverse to the longitudinal axis of the beam;

a first pin extending through aligned apertures in a wall of the slot and in the end section and removably maintaining the brake head on the end section; and a retainer mounted on the brake head retaining the first pin in the brake shoe and the end section.

14. A brake according to claim 13, wherein the retainer includes a tab on the brake head, and a portion of the tab is bent over the pin to retain it in the brake head and the end section.

15. A brake according to claim 13, wherein the brake beam includes two transverse walls, one on each side of the brake head, to limit movement of the brake head along the longitudinal axis.

16. A brake according to claim 15, wherein the slot, pin and separation of the transverse walls are dimensioned to allow the brake head to pivot about the pin.

17. A brake according to claim 13, wherein the slot and the pin are dimensioned to allow the brake head to pivot about the pin.

18. A brake according to claim 13, wherein the slot is formed by two flanges extending from the back of the brake head and vertically spaced sufficient to receive the end section of the beam.

19. A brake according to claim 18, wherein a portion of the center section of the beam extends lateral below a portion of the end section; and including a third flange extending from the back of the brake head and vertically spaced from the other two flanges sufficiently to engage the portion of the center section of the beam below the end section as a stop.

20. A brake according to claim 13, including a at least one opening in the brake head above the slot and having an axis transverse and intersecting a coaxial axis of the aligned apertures; and wherein the retainer includes a second pin extending through the opening above the first pin to retain the first pin in the openings.

21. A truck mounted rail brake comprising:

at least a primary beam including, along an longitudinal axis, a center section and at each end an end section having a guide end extension to be received in slots in a truck; and a brake head removably mounted to the end section by a first pin which is dimensioned to allow the brake head to pivot about the pin whose axis is transverse to the longitudinal axis of the beam.

22. A brake according to claim 21 including a second pin removably joined to the brake head and extending above the first pin along an axis transverse to and intersecting an axis of the first pin to retain the first pin in the openings.

23. A brake according to claim 22 wherein the second pin is a cotter pin.

24. A brake according to claim 21 including a tab on the brake head, a portion of the tab is bent over the pin to retain it in the brake head and the end section.

* * * * *